US010217597B2

(12) United States Patent
Chaki et al.

(10) Patent No.: US 10,217,597 B2
(45) Date of Patent: Feb. 26, 2019

(54) X-RAY GENERATOR AND X-RAY ANALYZER

(71) Applicant: RIGAKU CORPORATION, Tokyo (JP)

(72) Inventors: Tomohiro Chaki, Tokyo (JP); Manabu Noguchi, Tokyo (JP)

(73) Assignee: RIGAKU CORPORATION, Tokyo (JP)

( * ) Notice: Subject to any disclaimer, the term of this patent is extended or adjusted under 35 U.S.C. 154(b) by 212 days.

(21) Appl. No.: 15/502,976

(22) PCT Filed: Aug. 18, 2015

(86) PCT No.: PCT/JP2015/073166
§ 371 (c)(1),
(2) Date: Feb. 9, 2017

(87) PCT Pub. No.: WO2016/039092
PCT Pub. Date: Mar. 17, 2016

(65) Prior Publication Data

US 2017/0236679 A1 Aug. 17, 2017

(30) Foreign Application Priority Data

Sep. 12, 2014 (JP) ..... 2014-186171

(51) Int. Cl.
*H01J 35/10* (2006.01)
*H01J 35/28* (2006.01)
*H01J 35/26* (2006.01)

(52) U.S. Cl.
CPC ..... *H01J 35/28* (2013.01); *H01J 35/10* (2013.01); *H01J 35/26* (2013.01); *H01J 2235/081* (2013.01); *H01J 2235/086* (2013.01)

(58) Field of Classification Search
None
See application file for complete search history.

(56) References Cited

U.S. PATENT DOCUMENTS

2005/0190887 A1* 9/2005 Kim ..... H01J 35/14 378/125
2011/0051895 A1* 3/2011 Vogtmeier ..... A61B 6/032 378/92
2011/0188625 A1* 8/2011 Roshi ..... H01J 35/06 378/4

FOREIGN PATENT DOCUMENTS

JP 44-23539 Y1 10/1969
JP 3-043251 U 4/1991
(Continued)

OTHER PUBLICATIONS

International Search Report (PCT/ISA/210) dated Nov. 17, 2015, by the Japan Patent Office as the International Searching Authority for International Application No. PCT/JP2015/073166.
(Continued)

*Primary Examiner* — Hoon K Song
(74) *Attorney, Agent, or Firm* — Buchanan Ingersoll & Rooney PC

(57) ABSTRACT

An X-ray generator including a cathode, an anode provided with two X-ray generation zones, a casing in which the cathode and anode are accommodated, two air cylinders for causing the anode to move, two linear guides for guiding the movement of the anode, and a bellows serving as a seal member. The air cylinders and the linear guides are provided at different positions on a surface orthogonal to a center axis of the bellows. The air cylinders and the linear guides are provided uniformly in relation to the center axis.

11 Claims, 8 Drawing Sheets

(56) References Cited

FOREIGN PATENT DOCUMENTS

| | | | |
|---|---|---|---|
| JP | 05-135722 | A | 6/1993 |
| JP | 05-089809 | | 9/1993 |
| JP | 08-236050 | A | 9/1996 |
| JP | 2007-525807 | A | 9/2007 |
| JP | 2008-269933 | A | 11/2008 |

OTHER PUBLICATIONS

Written Opinion (PCT/ISA/237) dated Nov. 17, 2015, by the Japan Patent Office as the International Searching Authority for International Application No. PCT/JP2015/073166.

* cited by examiner

X-RAY GENERATOR AND X-RAY ANALYZER

TECHNICAL FIELD

The present invention relates to an X-ray generator having as anode that is equipped with a plurality of X-ray generation zones. The invention also relates to an X-ray analyzer that employs the X-ray generator.

BACKGROUND ART

In X-ray analyzers, i.e., X-ray diffractometers, fluorescent X-ray devices, small-angle X-ray scattering devices, and the like, X-rays generated from an X-ray generator irradiate a specimen targeted for analysis. In a typical X-ray generator, electrons generated from a cathode are made to collide against the surface of an anode, thereby generating X-rays from the surface of the anode. The region where the electrons collide, i.e., the region where X-rays are generated, is typically called the X-ray focal point.

The wavelength of the X-rays generated from the anode is determined by the material of the region that corresponds to the X-ray focal point in the anode. Known materials for anodes include Cu (copper), Mo (molybdenum), Cr (chromium), Co (cobalt), and the like. The material of the anode is selected, as appropriate, according to the type of analysis that is to be carried out. For example, in a case in which structural analysis of a protein is to be carried out by an X-ray diffractometer, a plurality of materials selected from the above plurality of materials would be employed.

According to Patent Literature 1, there is known an X-ray generator in which two types of X-ray generation zone are provided to a single anode, and one of two X-ray wavelengths is selectively generated as needed in a single X-ray generator by selectively disposing one of the zones in a position facing a cathode. In this X-ray generator, a mobile platform is caused to move by the rotation of a threaded shaft, whereby an anode supported by the mobile platform is caused to move relative to a cathode, and this relative motion causes one kind of X-ray zone among two to be selectively disposed in a position facing the cathode.

The device of Patent Literature 1 presents a problem in that parallel movement of the anode is caused by only one drive mechanism, which is disposed at a position separated from the center rotational axis of the anode, and therefore the anode oscillates laterally and tilts during the parallel movement, making for difficulty in correctly determining the position of the X-ray generation zone facing the cathode.

Furthermore, according to Patent Literature 2, there is known a configuration in which an anode housing supporting the anode is moved by negative pressure caused by air suction, and this movement causes one kind of X-ray zone among two on the anode to be selectively disposed in a position facing the cathode. However, in the device of Patent Literature 2, the negative pressure caused by air suction is applied to the anode at a position separated from the center rotational axis of the anode, and therefore the anode ends up oscillating laterally and tilting during parallel movement, making it difficult to correctly determine the position of the X-ray generation zone facing the cathode.

Also, according to Patent Literature 3, there is known a configuration in which a rotating anode provided with a plurality of X-ray generation zones is caused to move parallel to a cathode, whereby any one of the plurality of X-ray generation zones is caused to be disposed in a position facing the cathode. Moreover, in FIG. 5 of Patent literature 3 a technique for urging the anode in one direction using a spring is disclosed.

However, Patent Literature 3 does not indicate a specific configuration for causing parallel movement of the rotating anode. It follows that no explanation of a technique for preventing the anode from oscillating laterally or tilting during parallel movement is indicated.

Furthermore, according to Patent Literature 4, there is known a configuration in which a movable screw is caused to move, whereby a rotating anode provided with a plurality of X-ray generation zones is caused to move parallel to a cathode, which leads to any one of the plurality of X-ray generation zones being disposed in a position facing the cathode. Also, in FIG. 1 of Patent Literature 4, there is disclosed a technique for urging the anode via an elastic member such as a coil spring, in order to make it possible to move the movable screw with little force, offsetting the force with which the rotating anode is pushed toward art anode accommodating chamber at atmospheric pressure.

In the device of Patent Literature 4, the outer peripheral surface of the shaft portion of the rotating anode is made to function as a guiding surface and the rotating anode is caused to move in a parallel fashion. The shaft portion of the rotating anode functioning as a guiding surface is not the main point. Moreover, making the shaft portion of the rotating anode a highly precise guiding surface is extremely difficult from a processing perspective. Accordingly, the device of Patent Literature 4 presents the risk that the anode will oscillate laterally or tilt during parallel movement, causing difficulty in correctly determining the position of the X-ray generation zone facing the cathode.

CITATION LIST

Patent Literature

Patent Literature 1: Microfilm of Japanese Utility Model Application No. H3-043251 (Japanese Unexamined Utility Model Publication No. H3-43251)

Patent Literature 2: Japanese Unexamined Patent Application Publication No. 2008-269933

Patent Literature 3: Japanese Unexamined Patent Application Publication No. H5-135722

Patent Literature 4: Japanese Unexamined Patent Application Publication No. H8-236050

SUMMARY OF THE INVENTION

Technical Problem

In light of the problems with conventional devices mentioned above, it is an object of the present invention to provide, an X-ray generator that can prevent an anode provided with a plurality of X-ray generation zones from oscillating laterally or tilting during parallel movement, and can obtain correct and reproducible positional accuracy.

Solution to Problem

The X-ray generator according to the present invention comprising: a cathode for generating electrons; an anode provided facing the cathode and provided with at least two X-ray generation zones arranged adjacent to each other; a casing that has an interior space for accommodating the cathode and the anode and that is integral with the cathode; a plurality of driving means for causing the anode to move with respect to the casing; a plurality of guiding means for guiding the movement of the anode with respect to the casing; and a seal member for keeping the interior space of the casing airtight, the center axis of the seal member extending in a direction parallel to the direction in which the two or more X-ray generation zones are lined up; wherein; the plurality of driving means are provided to different positions in the surface orthogonal to the center axis of the seal member; the plurality of driving means are provided uniformly in relation to the center axis of the seal member; the plurality of guiding means are provided to different positions in the surface orthogonal to the center axis of the seal member, and the plurality of guiding means are provided uniformly in relation to the center axis of the seal member.

According to the X-ray generator of the present invention, the plurality of driving means and the plurality of guiding means are respectively disposed uniformly in relation to the center axis of the seal member, and therefore the anode can move correctly in a parallel fashion without tilting or oscillating laterally. Accordingly, at least two X-ray generation zones can face the cathode at the same distance and the same angle with respect to the cathode. In other words, positional accuracy with correct reproducibility can be obtained for the two X-ray generation zones with respect to the cathode. As a result, X-rays of different wavelengths can be generated under the same conditions from the two or more X-ray generation zones.

In the X-ray generator according to the present invention, it is desirable that the plurality of driving means be equidistant from one another with respect to the center axis of the seal member, and disposed at equiangular intervals from each other about the center axis. This configuration enables the "uniformity" of the abovementioned configuration to be realized. This configuration makes it possible to much more reliably prevent the anode from oscillating laterally or tilting during parallel movement.

In the X-ray generator according to the present invention, the plurality of driving means are equidistant from one another with respect to the center axis of the seal member, and can be disposed in the surface orthogonal to the center axis point-symmetrically with respect to the center axis or line-symmetrically with respect to a line passing through the center axis. This configuration enables the "uniformity" of the abovementioned configuration to be realized.

In the X-ray generator according to the present invention, the plurality of guiding means are equidistant from one another with respect to the center axis of the seal member, and can be disposed at equiangular intervals from each other about the center axis. This configuration enables the "uniformity" of the abovementioned configuration to be realized. This configuration makes it possible to much more reliably prevent the anode from oscillating laterally or tilting during parallel movement.

In the X-ray generator according to the present invention, the plurality of guiding means can be disposed in the surface orthogonal to the center axis of the seal member point-symmetrically with respect to the center axis or line-symmetrically with respect to a line passing through the center axis. This configuration enables the "uniformity" of the abovementioned configuration to be realized.

The X-ray generator according to the present invention may further comprise an exhaust means for exhausting the interior space of the casing and reducing pressure, and a plurality of elastic-force-imparting means for urging the anode in the direction of exit from the interior space of the casing. The plurality of elastic-force-imparting means may be provided to different positions in the surface orthogonal to the center axis of the seal member, and the plurality of elastic-force-imparting means may be provided uniformly in relation to the center axis of the seal member. If elastic-force-imparting means are provided, the suction force in the anode subjected to vacuum suction can be moderated by the elastic force generated by the elastic-force-imparting means.

In the X-ray generator according to the present invention, it is desirable that the plurality of elastic-force-imparting means be equidistant from one another with respect to the center axis of the seal member, and disposed at equiangular intervals from each other about the center axis. This makes it possible to much more reliably prevent the anode from oscillating laterally or tilting during parallel movement. This configuration enables the "uniformity" of the abovementioned configuration to be realized.

In the X-ray generator according to the present invention, the plurality of elastic-force-imparting means may be disposed in the surface orthogonal to the center axis of the seal member point symmetrically with respect to the center axis or line symmetrically with respect to a line passing through the center axis. This configuration enables the "uniformity" of the abovementioned configuration to be realized.

In the X-ray generator according to the present invention, the seal member may comprise a bellows. By using a bellows, a support plate which supports the anode can move smoothly in a parallel fashion while the interior space of the casing is kept airtight.

In the X-ray generator according to the present invention, the driving means may comprise an air cylinder for causing an output rod to move back and forth by the force of air. This enables an anode support body to be moved quickly in a parallel fashion with the correct stroke, i.e., the correct movement distance.

Next, the X-ray analyzer of the present invention comprises an X-ray generator of the configuration disclosed above, and an X-ray optical system employing X-rays generated by the X-ray generator. An X-ray optical system configured by, e.g., a divergence slit, a specimen, an scattering slit, a light receiving slit, and an X-ray detector. Other X-ray optical components may also be included in the X-ray optical system as needed. Such X-ray optical components may include, e.g., a collimator, a solar slit, and a monochromator.

According to the X-ray analyzer of the present invention, in the built-in X-ray generator, a plurality of driving means and a plurality of guiding means are respectively disposed uniformly in relation to the center axis of a seal member, and therefore an anode moves correctly in a parallel fashion without oscillating laterally or tilting. Accordingly, at least two X-ray generation zones can face a cathode at the same distance and the same angle with respect to the cathode. In other words, positional accuracy with correct reproducibility can be obtained for the two X-ray generation zones with respect to the cathode. As a result, X-rays of different wavelengths can be generated under the same conditions from the different X-ray generation zones.

Advantageous Effects of Invention

According to the X-ray generator and X-ray analyzer of the present invention, a plurality of driving means and a plurality of guiding means are respectively disposed uniformly in relation to the center axis of a seal member, and therefore an anode moves correctly in a parallel fashion without oscillating laterally or tilting. Accordingly, at least two X-ray generation zones can face the cathode at the same distance and the same angle with respect to the cathode. In other words, positional accuracy with correct reproducibility can be obtained for the two X-ray generation zones with respect to the cathode. As a result, X-rays of different wavelengths can be generated under the same conditions from the two or more X-ray generation zones.

DESCRIPTION OF EMBODIMENTS

Figure 1:
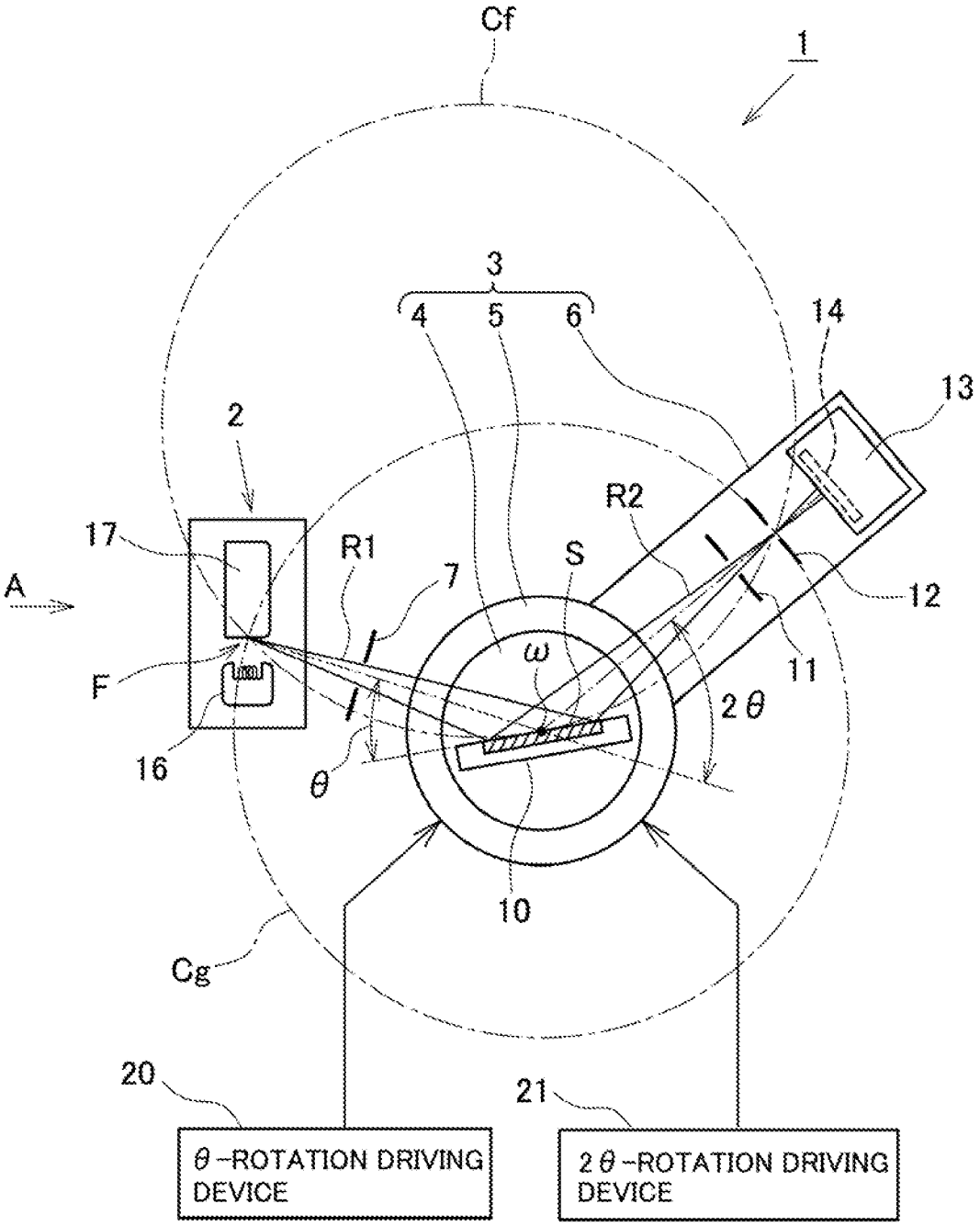
FIG. 1 is a front view showing an embodiment of the X-ray analyzer according to the present invention.

The X-ray generator and the X-ray analyzer each according to the present invention shall be described below on the basis of embodiments. The present invention is not limited to these embodiments, as shall be apparent. In the drawings appended to the present description, constituent elements are in some instances depicted at a scale different from the actual one, in order to facilitate understanding of characteristic features.

(X-ray Diffractometer)

FIG. 1 is a front view showing an X-ray diffractometer 1 as an embodiment of the X-ray analyzer according to the present invention. The in-plane direction of the page in the drawing is the vertical direction, and the direction passing through the page is the horizontal direction. This X-ray diffractometer 1 has an X-ray generator 2 and a goniometer 3. The goniometer 3 has a θ-rotation platform 4, a 2θ-rotation platform 5, and a detector arm 6 that extends from the 2θ-rotation platform 5.

The θ-rotation platform 4 is rotatable about its own center axis ω. The center axis ω extends in a direction passing through the page in FIG. 1. The 2θ-rotation platform 5 is also rotatable about this same center axis ω. A divergence slit 7 is disposed between the X-ray generator 2 and the goniometer 3. This divergence slit 7 regulates divergence of X-rays exiting from the X-ray generator 2, and causes the X-rays to irradiate a specimen S.

A specimen holder 10 is detachably installed on the θ-rotation platform 4, and the specimen S being measured is accommodated within the specimen holder 10. For example, the specimen 5 may be packed into a recessed portion or through-opening provided to the specimen holder 10. On the detector arm 6 are provided a scattering slit 11, a receiving slit 12, and a two-dimensional X-ray detector 13 by way of an X-ray detection means. The scattering slit 11 prevents scattered rays which are unwanted for the purposes of analysis from entering the X-ray detector 13. The receiving slit 12 passes secondary X-rays, e.g., diffracted X-rays, exiting from the specimen S, while blocking other unwanted X-rays.

The two-dimensional X-ray detector 13 has a two-dimensional sensor 14. The two-dimensional sensor 14 is an X-ray sensor that has a position resolution function in a two-dimensional area (i.e., within a plane). A position resolution function is a function for detecting X-ray intensity on a per position basis. This two-dimensional sensor 14 is an X-ray detector having, for example, a plurality of photon-counting type pixels arranged two-dimensionally (i.e., in planar fashion). The sensor has the function of outputting electrical signals of magnitude that corresponds to the intensify of X-rays received by the individual photon-counting type pixels. Therefore, the two-dimensional sensor 14 is designed to simultaneously receive in planar fashion X-rays from a plurality of pixels, and independently output electrical signals from each of the pixels.

The two-dimensional sensor 14 could also be configured from a two-dimensional charge coupled device (CCD) sensor. A two-dimensional CCD sensor is a two-dimensional sensor in which individual pixels for receiving X-rays are formed by CCDs.

Depending on the type of measurement being performed, a one-dimensional X-ray detector could be used in place of the two-dimensional X-ray detector 13. A one-dimensional X-ray detector is an X-ray detector that has a position resolution function within a one-dimensional area (i.e., within a linear area). The one-dimensional X-ray detector could be, for example, a position sensitive proportional counter (PSPC), an X-ray detector that employs a one-dimensional CCD sensor, an X-ray detector in which a plurality of photon-counting type pixels are arranged one-dimensionally, or the like.

Depending on the type of measurement being performed, a 0 (zero) dimensional X-ray detector could be used, in place of the two-dimensional X-ray detector 13. A 0 (zero) dimensional X-ray detector is an X-ray detector that lacks a position resolution function relating to X-ray intensity. This 0 (zero) dimensional X-ray detector could be, for example, an X-ray defector that employs a proportional counter (PC), an X-ray detector that employs a scintillation counter (SC), or the like.

The X-ray generator 2 is fixedly arranged at a given position. This X-ray generator 2 has a cathode 16 that emits thermal electrons through electrical conduction, and a rotating anode 17 arranged facing the cathode 16. Electrons emitted from the cathode 16 collide at high speed with the outer peripheral surface of the rotating anode 17. The area in which the electrons collide is an X-ray focal point F, and X-rays are generated at this X-ray focal point. The planar shape of the X-ray focal point is, for example, 0.3 mm×3 mm. The X-rays R1 generated from the rotating anode 17, the divergence angle thereof having been regulated by the divergence slit 7, impinge on the specimen S.

The θ-rotation platform 4 rotates about the ω-axis while driven by a θ-rotation driving device 20. This rotation is intermittent rotation at prescribed step angles, or continuous rotation at a prescribed angular velocity. This rotation of the θ-rotation platform 4 is rotation char takes place in order to change the angle of incidence θ of X-rays on the specimen S, and is typically called θ-rotation.

The 2θ-rotation platform 5 rotates about the ω-axis while driven by a 2θ-rotation driving device 21. This rotation is typically called 2θ-rotation. This 2θ-rotation is rotation that takes place in such a way that when secondary X-rays (e.g. diffracted X-rays) R2 are generated from the specimen S at times when X-rays are incident on the specimen S at an incident angle θ, the secondary X-rays can be received by the X-ray detector 13.

The θ-rotation driving device 20 and the 2θ-rotation driving device 21 may be configured with any rotation driving devices. Such a rotation device may be configured, for example, from a rotation power source and a power transmission device. The rotation power source may be configured, for example, with a controllable-rotation speed motor, e.g., a servo motor, or a stepping motor. The power transmission device may be configured, for examples, with a worm secured to the output shaft of the rotation power source, and a worm wheel that meshes with the worm, and is secured to the center shaft of the θ-rotation platform 4 or to the center shaft of the 2θ-rotation platform 5.

When the θ-rotation platform 4 and the specimen S installed thereon undergo θ-rotation, and the 2θ-rotation platform 5 and the X-ray detector 13 supported thereon undergo 2θ-rotation, the X-ray focal point F is fixedly arranged on a goniometer circle Cg that is centered on the axis ω, while the X-ray collection point of the receiving slit 12 moves over the goniometer circle Cg. During θ-rotation of the specimen S and 2θ-rotation of the X-ray detector 13, the X-ray focal point F, the ω-axis, and the X-ray collection point of the receiving slit 12 are present on a focusing circle Cf. The goniometer circle Cg is a constant-radius hypothetical circle, and the focusing circle Cf is a hypothetical circle that changes in radius in association with changes of the θ angle and the 2θ angle.

In the present embodiment, the X-ray optical system is configured with the divergence slit 7, the specimen S, the scattering slit 11, the receiving slit 12, and the X-ray detector 13.

If needed, the X-ray optical system may include other X-ray optical elements. Such X-ray optical elements could be, for example, a collimator, a solar slit, a monochromator, or the like.

The operation of the X-ray diffractometer 1 configured as described above will be described below.

First, if needed, the various X-ray optical elements present on the X-ray path leading from the X-ray focal point F to the X-ray detector 13 are correctly aligned in position on the X-ray optical axis. That is, optical axis adjustment is performed. Next, the X-ray incident angle θ with respect to the specimen S and the diffraction angle 2θ of the X-ray detector 13 are set to the desired initial positions (zero positions).

Next, by passing current through the cathode 16 to heat it, thermal electrons are generated from the cathode 16. These electrons, while being restricted in the direction of advance by an electric field that is usually applied by a Wehnelt (not illustrated), collide at high speed against the surface of the rotating anode 17 and form the X-ray focal point F. X-rays of wavelength that is dependent on the material of the rotating anode 17 are then emitted from the X-ray focal point F. The current that flows to the rotating anode 17 from the cathode 16 due to conduction to the cathode 16 is typically called tube current. In order to accelerate the electrons that are emitted from the cathode 16 and collide with the rotating anode 17, a prescribed large voltage is applied across the cathode 16 and the rotating anode 17. This voltage is typically called tube voltage. In the present embodiment, the tube voltage and the tube current are respectively set to 30-60 kV and 10-120 mA. The rotating anode material will be discussed below.

The X-rays R1 that are emitted and diverge from the X-ray generator 2 include continuous X-rays that include X-rays of various wavelengths, and characteristic X-rays of specific wavelength. In cases in which it is desired to select desired characteristic X-rays from among these X-rays, an incidence-side monochromator (an "incident monochromator") is disposed on the X-ray optical path leading from the X-ray generator 2 to the specimen S. The X-rays R1, divergence of which is regulated by the divergence slit 7, irradiate the specimen S. During intervals in which the specimen is undergoing θ-rotation and the X-ray detector 13 is undergoing 2θ-rotation, when the X-rays R1 incident on the specimen S meet a prescribed rotation condition with respect to the crystal lattice planes inside the specimen, specifically, an angular state that satisfies the Bragg's diffraction angle, secondary X-rays, e.g., diffracted rays R2, are generated at a diffraction angle of 2θ from the specimen S. These diffracted rays R2 pass through the scattering slit 11 and the receiving slit 12 to be received by the X-ray detector 13. The X-ray detector 13 outputs a signal that is dependent on the count of X-rays received at individual pixels of the X-ray detector 13, and X-ray intensity is calculated on the basis of this output signal.

The afore described X-ray intensity calculation process is carried out on each angle among the incident X-ray angles θ and the diffraction angles 2θ, as a result of which there is derived an X-ray intensity I(2θ) at each angular position of the diffraction angle 2θ. By plotting the X-ray intensity I(2θ) on plane coordinates where the diffraction angle 2θ is the horizontal axis and the X-ray intensity I is the vertical axis, a diffraction line pattern of known type is derived. By then observing the generated intensity (I) and the angle (2θ) at which the X-ray intensity peak waveform appearing on the diffraction line pattern is generated, the internal structure of the specimen S can be analyzed.

(X-ray Generator)

The X-ray generator 2 will be described in detail below.

Figure 2:
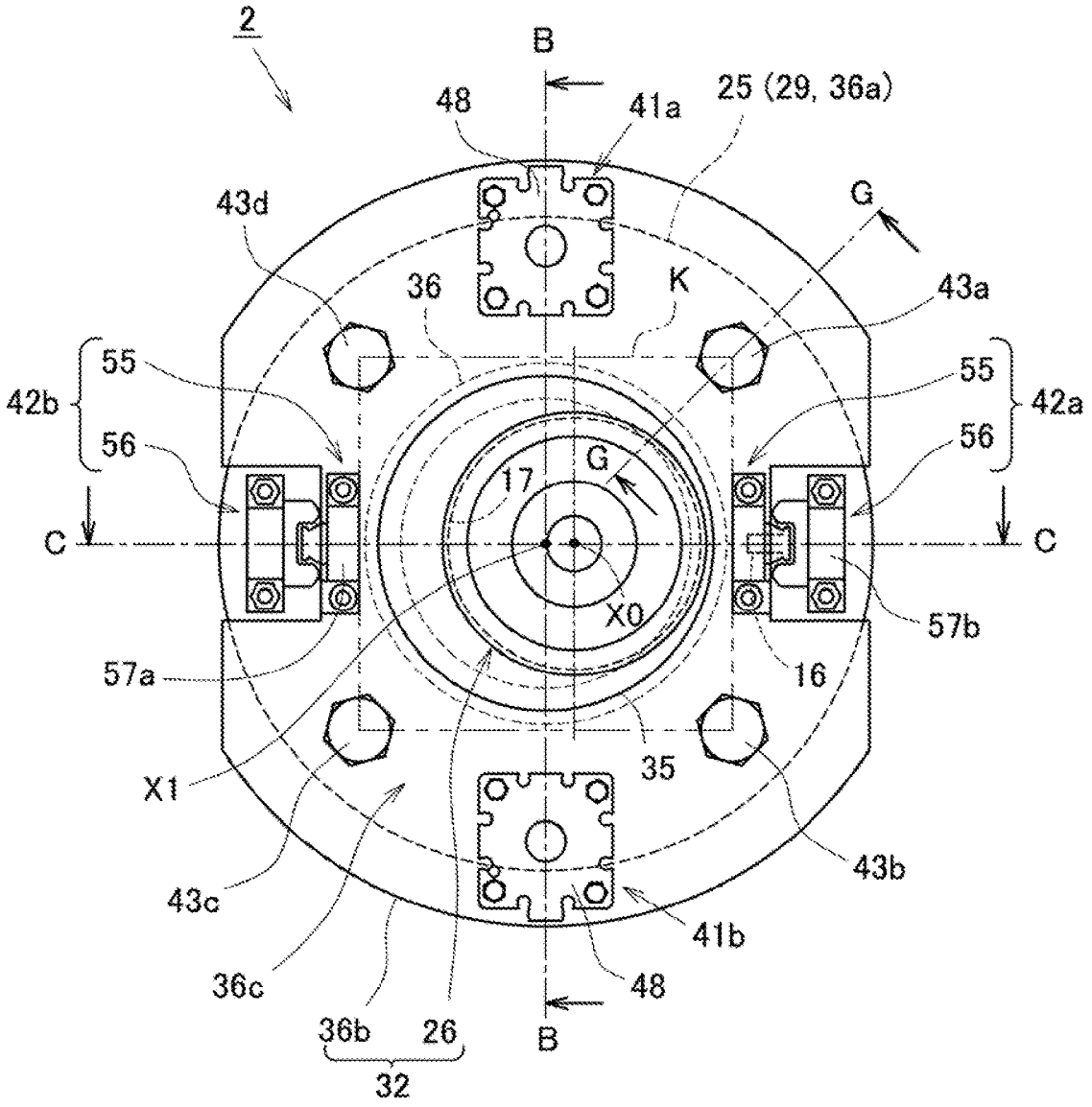
FIG. 2 is a side view showing art embodiment of the X-ray generator according to the present invention, viewed along arrow A in FIG. 1.
Figure 3:
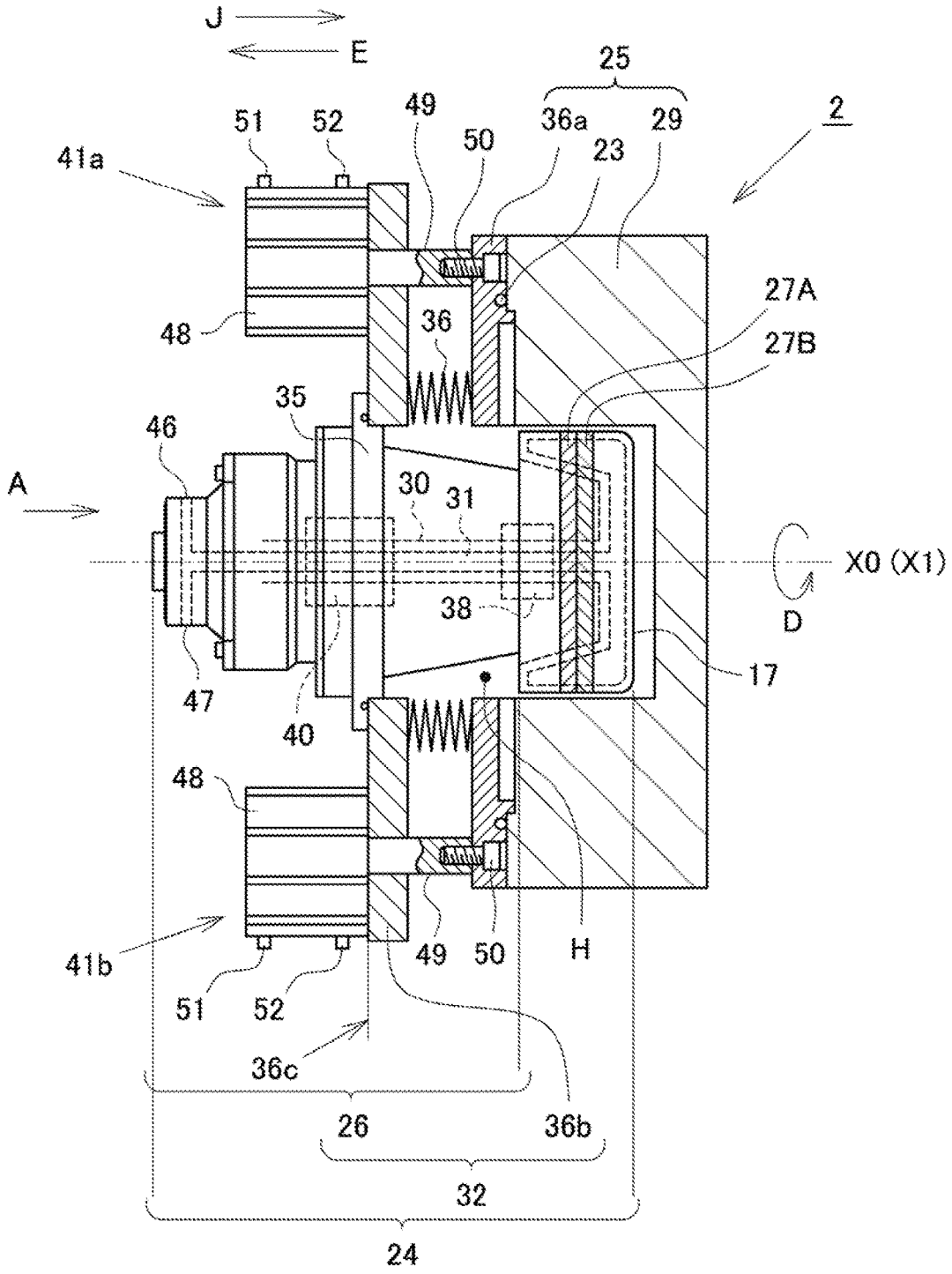
FIG. 3 is a sectional longitudinal view of the X-ray generator, taken along line B-B in FIG. 2.
Figure 4:
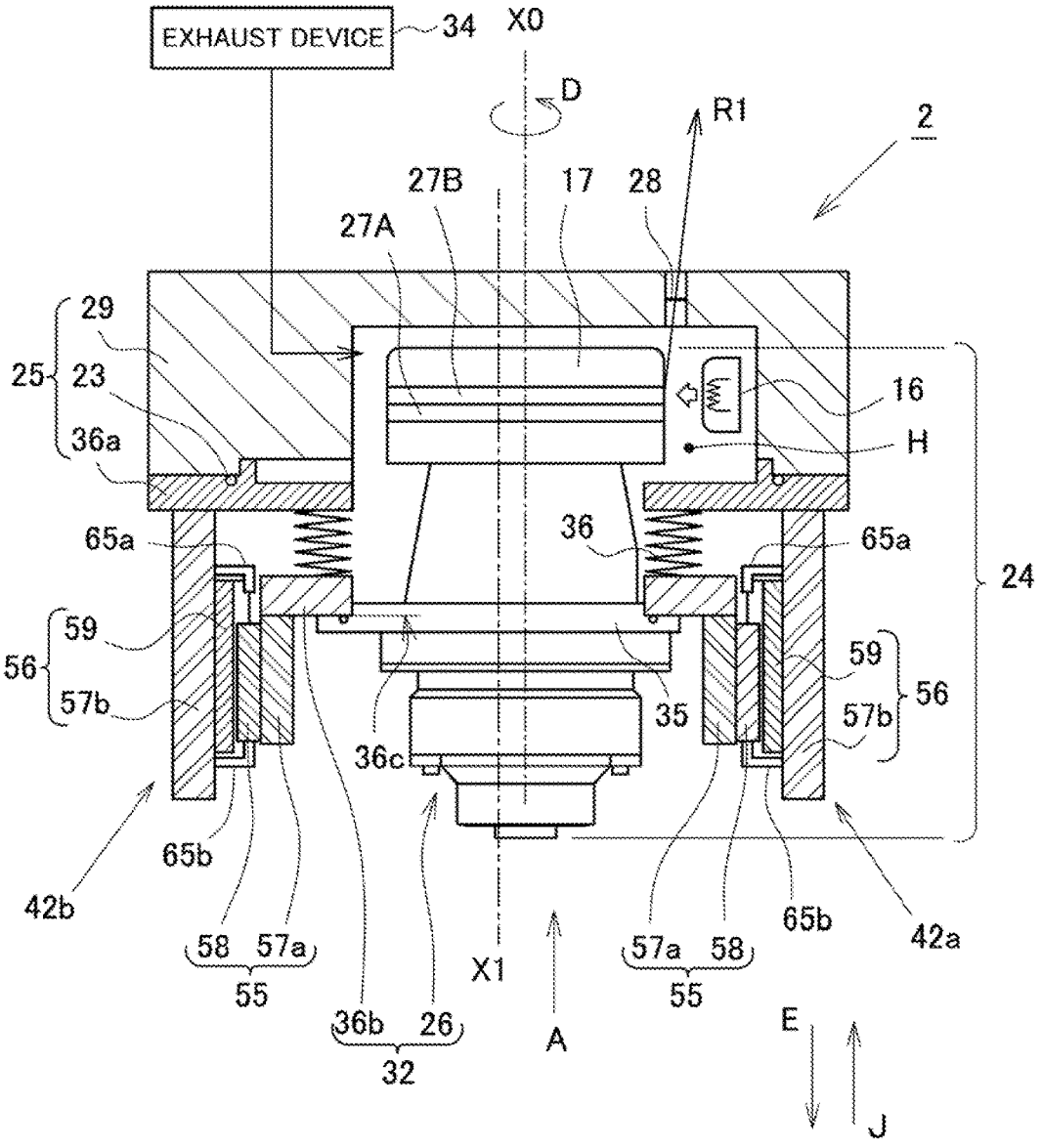
FIG. 4 is a sectional plan view of the X-ray generator, taken along line C-C in FIG. 2.

FIG. 2 shows the X-ray generator 2 viewed along arrow A in FIG. 1. FIG. 3 shows the longitudinal cross sectional structure of the X-ray generator 2, taken along line B-B in FIG. 2. FIG. 4 shows the planar cross sectional structure of the X-ray generator, taken along line C-C in FIG. 2. In FIG. 2 and FIG. 4, the X-ray generator 2 has the cathode 16 mentioned previously, the rotating anode 17 mentioned previously, an anode unit 24 that includes the rotating anode 17, and a bellows 36, as a seal material.

In the present embodiment, a welded bellows is employed as the bellows 36. The welded bellows has an accordion shape in which the outer peripheries and inner peripheries of a plurality of thin ring-shaped metal plates are joined together by welding. The bellows 36 is round in shape when viewed in the direction of arrow A, and cylindrical in shape overall. On the outer peripheral surface of the rotating anode 17 are disposed two X-ray generation zones 27A, 27B, which are lined up adjacently to one another. The center axis X1 of the cylindrical shape of the bellows 36 extends in the direction in which the X-ray generation zones 27A to 27E are lined up (the vertical direction in FIG. 4).

One end of the bellows 36 (the end at the top side in FIG. 4) is anchored to a first flange 36*a*, by welding for example. The other end of the bellows 36 (the end at the bottom in FIG. 4) is anchored to a second flange 36*b*, by welding for example.

For the planar shape and thickness of the first flange 36*a* and the second flange 36*b*, there can be adopted any shape besides the illustrated shapes, as needed. In some instances, the bellows 36 can be formed by a molded bellows instead of a welded bellows, or by a bellows of some other configuration. Molded bellows are bellows that have been formed by a molding process, instead of welding.

In FIG. 3 and FIG. 4, the first flange 36*a* of the bellows 36 is anchored by a bolt or other fastening means to a base 29 which is a metal member. An O-ring (i.e., and elastic ring) 23 for maintaining airtightness is interposed between the base 29*a* and the first flange 36*a*. A casing 25 is formed by the base 29 and the first flange 36*a*. The casing 25 has an internal space H for accommodating the anode 17 and the cathode 16. The base 29 (and hence the casing 25) and the cathode 16 are integrated.

An X-ray window 28 for extraction of the X-rays R1 generated by the rotating anode 17 is disposed in a section of the base 29 of the casing 25. The X-ray window 28 is formed from a material though which X-rays can pass, for example, beryllium (Be).

The rotating anode unit 24 has an anode housing 26 that supports the rotating anode 17 and extends to the outside of the rotating anode 17. The anode housing 26 rotatably supports the rotating anode 17 about the axis X0 as shown by arrow D. The base 29 and the anode housing 26 are formed, for example, from copper or copper alloy. The anode housing 26 is formed to cylindrical shape as viewed from the direction of arrow A. The base 29 is formed to cylindrical shape as viewed from the direction of arrow A. The base 29 may be a cornered tube shape as well.

The rotating anode 17 is formed by disposing in a row arrangement two types of X-ray generation zones 27A and 27B, on the outer peripheral surface of a base member formed from a material having high thermal conductivity (e.g., copper (Cu) or a copper alloy). The rotating anode 17 has a cup shape whose top is a closed plane as shown in FIG. 4. The X-ray generation zones 27A and 27B are lined up in the direction of extension of the center axis X0 of the rotating anode 17 (i.e., the axial direction of the rotating anode unit 24) and disposed in ring shape (i.e. annular shape) in a band shape.

The X-ray generation zones 27A and 27B are formed from mutually different materials, each being one material selected, e.g., from among Cu, Mo (molybdenum), Cr (chromium), Co (cobalt), or other metals. The materials Mo, Cr, and Co are formed on a Cu base member, for example, by ion plating, plating, shrink fitting, or other appropriate film forming method. Where the dimensions of the X-ray focal spot F are 0.3 mm×3 mm, the widths of the X-ray generation zones 27A, 27B in the axial direction are set to about 5 mm.

The anode housing 26 is formed to generally cylindrical shape centered on the axis X0. As shown in FIG. 3, in the interior of the anode housing 26 are disposed a rotating shaft 30 which is integrated with the rotating anode 17, a motor 40 serving as the rotation driving device for driving rotation of the rotating shaft 30, a magnetic seal device 38 disposed around the rotating shaft 30, and a water passage 31 for water used to cool the rotating anode 17. The rotating anode 17 rotates upon being driven by the motor 40. The rotation speed of the rotating anode 17 is 6,000 rpm, for example.

The magnetic seal device 38 is a shaft seal device for maintaining a pressure differential between the internal space H of the casing 25, which is in a high vacuum state, and the internal space of the anode housing 26, which communicates with atmospheric pressure. The magnetic seal device 38 has a magnetic fluid deposited on the outer peripheral surface of the rotating shaft 30 by magnetic force. Due to this magnetic fluid, a high vacuum is maintained to one side of the magnetic seal device 38, and atmospheric pressure to the other side. Because the magnetic fluid does not exert significant torque on the rotating shaft 30, the magnetic seal device 38 does not hamper rotation of the rotating shaft 30.

The water passage 31 connects to a water supply port 46 and a water discharge port 47 which are disposed at the back end of the anode housing 26 (the left end in FIG. 3). Cooling water introduced into the anode housing 26 from the water supply port 46 is fed to the interior of the rotating anode 17 through the outbound section of the water passage 31, and cools the rotating anode 17 from the inside, and thereafter passes through the return section of the water passage 31 and is discharged to the outside from the water discharge port 47.

The internal structure of the rotating anode unit 24 is generally as described above. More specifically, the internal structure of the rotating anode unit disclosed, for example, in Japanese Unexamined Patent Application Publication 2008-269933 can be adopted.

In FIG. 3 and FIG. 4, the second flange 36*b* of the bellows 36 is secured to a flange 35 which is provided to the anode housing 26. The bellows 36 keeps the internal space H of the casing 25 in an airtight state with respect to atmospheric pressure. As shown in FIG. 4, this internal space H connects to an exhaust device 34. The exhaust device 34 evacuates air from within this internal space H and maintains a high vacuum (hereinafter simply termed a "vacuum state") in the internal space H.

The exhaust device 34 can be configured, for example, as a combination of a rotary pump and a turbo molecular pump. The rotary pump is a pump that can reduce the pressure in the internal space H to a low vacuum. The turbo molecular pump is a pump that can further evacuate to a high vacuum state the atmosphere that has been reduced in pressure by the rotary pump. Through the action of this turbo molecular pump, the surrounding area of the rotating anode 17 and the cathode 16 can be placed under a high vacuum of $10^{-3}$ Pa or lower. Provided that the interior of the casing 25 can be placed in a high vacuum state, a combination of a high vacuum pump other than a turbo molecular pump and an auxiliary pump other than a rotary pump can be adopted.

In the present embodiment, the casing 25 is secured at an appropriate location of the X-ray diffractometer 1 of FIG. 1. In FIG. 4, the bellows 36 is a member which is extendable along its own center axis X1. In the present embodiment, the center rotational axis X0 of the rotating anode 17 deviates from the center axis X1 of the bellows 36. Naturally, the center rotational axis X0 of the anode housing 26 may be aligned with the center axis X1 of the bellows 36.

By disposing the bellows 36 between the casing 25 and the anode housing 26 in FIG. 4, even if the second flange 36*b* undergoes advancing or retracting motion with respect to the casing 25, the internal space H surrounding the anode 17 can be maintained in an airtight state by the extending and contracting action of the bellows 36. In the present embodiment, the anode housing 26 and the second flange 36*b* constitute an anode support body 32 for supporting the anode 17.

In FIG. 2, the surface 36*c* of the second flange 36*b* on the side away from the anode 17 (the front side in FIG. 2) is provided with a plurality (in the present embodiment, two) of air cylinders 41, 41*b* as driving means, a plurality (in the present embodiment, two) of linear guides 42*a*, 42*b* as guiding means, a plurality (in the present embodiment, four) of assist units 43*a*, 43*b*, 43*c* 43*d* as elastic force imparting means. In this manner the second flange 36*b* of the bellows 36 functions as a support plate for supporting these devices, i.e., the air cylinders 41, 41*b*, the linear guides 42*a*, 42*b*, the assist units 43*a*, 43*b*, 43*c*, 43*d*, and the stopper devices 44*a*, 44*b* 44*c*, 44*d*. Hereinafter, the second flange 36*b* is sometimes referred to as a support flange 36*b*.

In FIG. 4, the linear guides 42*a* 42*b* have dovetail tail units 55 and dovetail groove units 56. The dovetail tail units 55 have a support column 57*a* secured to the surface 36*c* of the support plate 36*b*, and a dovetail tail 58 serving as a guided member and disposed on a side surface of the support column 57*a*. The support column 57*a* and the dovetail tail 58 extend in the direction of the center axis X1 of the bellows 36. The dovetail groove units 56 have a support column 57*b* secured to the first flange 36*a* constituting the casing 25, and a dovetail groove member 59 serving as a guide member and disposed on a side surface of the support column 57*b*. The support column 57*b* and the dovetail groove member 59 also extend in the direction of the center axis X1 of the bellows 36.

The dovetail tails 58 mate with the dovetail grooves of the dovetail groove members 59. The mating of the dovetail tails and the dovetail grooves involves mating in such a way that the parts are slidable in the lengthwise direction (i.e., capable of sliding movement), but are not able to release from the mated state in directions perpendicular to the lengthwise direction. The anode support body 32 which supports the anode 17 moves parallel to the casing 25 as shown by arrow E and arrow J while being guided by the linear guides 42*a*, 42*b*. Through this action of the linear guides 42*a*, 42*b*, the anode support body 32 is guided in such a way as to not experience lateral swaying or tilting. In so doing, the anode 17 can experience parallel movement without laterally swaying and without tilting within the internal space H of the casing 25.

A first stopper 65*a* and a second stopper 65*b* are provided to the side surface of the support post 57*b* of the dovetail groove unit 56. The first stopper 65*a* is disposed in the vicinity of the end of the dovetail groove member 59 nearer the anode 17. The second stopper 65*b* is disposed in the vicinity of the end of the dovetail groove member 59 farther from the anode 17. The anode support body 32 is capable of moving in a parallel fashion in the direction of the arrow E and the direction of the arrow J within an area demarcated by the first stopper 65*a* and the second stopper 65*b*.

As shown in FIG. 3, the air cylinders 41*a*, 41*b* shown in FIG. 2 have a cylinder body 48 and an output rod 49. The cylinder body 48 is secured onto the surface 36*c* of the support plate 36*b*, on the opposite side thereof from the anode 17. The distal end of the output rod 49 is secured to the first flange 36*a*, i.e., to the casing 25, by a bolt 50.

The cylinder body 48 is provided with a first air connection port 51 and a second air connection port 52. These air connection ports are connected to an air supply source, not illustrated. When air is supplied to the first air connection port 51, the output rod 49 experiences extending motion. Due to this extending motion, the support plate 36*b* experiences parallel motion in a direction away from the casing 25 as shown by arrow E. When air is supplied to the second air connector port 52, the output rod 43 experiences contracting motion. Due to this contracting motion, the support plate 36*b* experiences parallel motion in a direction towards the casing 25 as shown by arrow J. When the support plate 36*b* experiences parallel motion in the direction of arrow E or the direction of arrow J, the anode 17 which is integrated therewith experiences parallel motion in the same direction. Due to this parallel motion of the anode 17, any one of the X-ray generation zones 27A and 27B provided on the anode 17 can be selectively transported to a position facing the cathode 16 (see FIG. 4).

Figure 5:
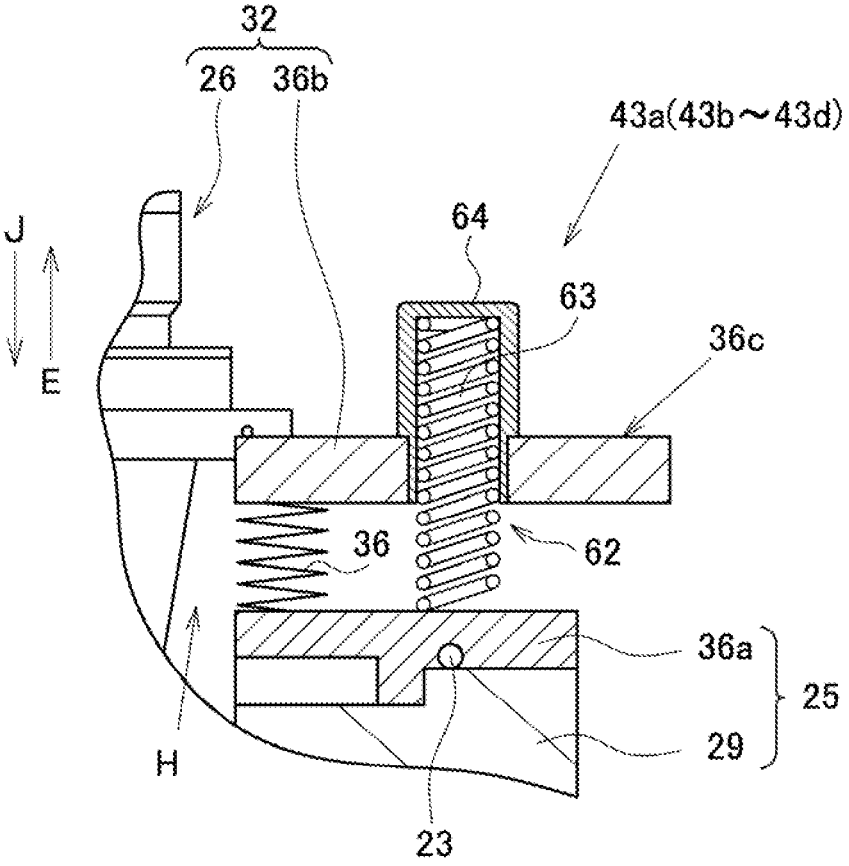
FIG. 5 is a sectional view of the assist unit, taken along line G-G in FIG. 2.

FIG. 5 shows a cross sectional structure of an assist unit 43*a*, taken in the longitudinal direction along line G-G in FIG. 2. The other assist units 43*b*, 43*c*, 43*d* are identical in structure. The assist unit 43*a* has a through-hole 62 that opens through the support plate 36*b* constituting the second flange of the bellows 36, a compression spring 63 that abuts at one end the first flange 36*a* of the bellows 36, and a spring cover 64 fitted at one end into the through-hole 62 of the support plate 36*b*. The compression spring 63 passes through the through-hole 62 of the support plate 36*b*.

An end of the spring cover 64 which is fitted into the through-hole 62 of the support place 36*b* is open, and the end on the opposite side therefrom is closed. The spring cover 64 compresses the compression spring 63 by means of the closed end. The compression spring 63 imparts to the anode support body 32 spring force (i.e., elastic force) commensurate to the compressed length. In this way, the anode support body 32 is urged in the direction of arrow E (i.e., a direction away from the internal space H) by the compression spring 63.

In FIG. 4, the internal space H is evacuated and set to a vacuum state by the exhaust device 34. For this reason, the anode support body 32 which comprises the anode housing 26 and the support plate 36*b* tends to be pushed by atmospheric pressure pushing it in the direction of arrow J (i.e., the direction towards the internal space H). The urging force exerted in the direction of arrow E on the anode support body 32 by the compression spring 63 of FIG. 5 acts as force to push back in the opposite direction the anode support body 32 which is being vacuum suctioned, to produce a balance of force.

The X-ray generator 2 of the present embodiment is configured as described above, and therefore when one X-ray generation zone 27B faces the cathode 16, as shown in FIG. 4, X-rays of the wavelength corresponding to the metal used in forming the X-ray generation zone 27B are emitted from the X-ray generation zone 27B in all directions. Some of these X-rays exit to the exterior through the X-ray window 28. These X-rays R1 are used in the X-ray analysis measurement in FIG. 1 in the manner previously described.

When X-rays from the X-ray generation zone 27A of FIG. 4 are needed in order to change the conditions of X-ray analysis measurement, the air cylinder 41*a* and the air cylinder 41*b* of FIG. 3 are caused to operate simultaneously and the anode support body 32 is caused to move in the direction approaching the casing 25 (the direction of the arrow J). When the support plate 36*b* constituting the anode support body 32 has moved in a parallel fashion in the direction of the arrow J, the dovetail tail 58 in FIG. 4 hits the first stopper 65*a* and stops, and the movement of the support plate 36*b* is halted. In this way, the X-ray generation zone 27A is disposed in a position facing the cathode 16. When thermal electrons are emitted from the cathode 16 in this state, X-rays of the wavelength corresponding to the metal used in forming the X-ray generation zone 27A are emitted from the X-ray generation zone 27A, and some of the X-rays exit to the exterior through the X-ray window 28.

As described above, in the X-ray diffractometer 1 of FIG. 1, the wavelength of the X-rays coming from the X-ray generator 2 can be changed according to the type of measurement. The air cylinders 41*a*, 41*b* of FIG. 2 and FIG. 3 cause the anode unit 24 to move in a parallel fashion and the anode 17 is caused to move in a parallel fashion. Also, the linear guides 42*a*, 42*b* of FIG. 2 and FIG. 4 guide the anode unit 24 so that the anode 17 moves correctly in a parallel fashion.

The assist units 43*a*-43*d* of FIG. 2 and FIG. 5 impart bias force in the opposite direction with respect to the anode unit 24 suctioned by the exhaust device 34 of FIG. 4, whereby the parallel movement of the anode 17 is made smoother.

In the present embodiment, all of the elements among the air cylinders 41*a*, 41*b* serving as the driving means, the linear guides 42*a*, 42*b* serving as the guide means, the assist units 43*a*-43*d* serving as the elastic force-imparting means are disposed together on the support plate 36*b* which is a single member, and specifically on the second flange 36*b* of the bellows 36, whereby the X-ray generator 2 can be given an overall configuration which is very compact.

In FIG. 2, the surface 36*c* of the support plate 36*b* that is the second flange of the bellows 36 is orthogonal to the center axis X1 of the bellows 36. The two air cylinders 41*a* and 41*b* are provided at different positions on the surface 36*c*. Also, the air cylinders 41*a* and 41*b* are provided uniformly in relation to the center axis X1 of the bellows 36.

Furthermore, the two linear guides 42*a* and 42*b* are also provided to different positions on the surface 36*c*. The linear guides 42*a* and 42*b* are also provided uniformly in relation to the center axis X1 of the bellows 36. Moreover, the four assist units 43*a*-43*d* are also provided to different positions on the surface 36*c*. The assist units 43*a*-43*d* are also provided uniformly in relation to the center axis X1 of the bellows 36.

In the present description, "uniformity" of the plurality of members refers to a state of arrangement of the plurality of members in such a way that when equal forces are applied to the members in the same direction, the point of application of the resultant force which is a force synthesized from these forces is generally aligned with the center axis X1 of the bellows 36 serving as the seal member. Here, the term "generally" in the wording "generally aligned" is used in a sense that includes cases in which the point of application of the resultant force diverges from the center axis X1 by an extent such that the anode unit 24 supported by the anode support body 32 as shown in FIG. 3 and FIG. 4 can undergo parallel motion without significant tilt and with no practical difficulty.

Specifically, in FIG. 2, when forces of equal magnitude are applied in the same direction to the two air cylinders 41*a* and 41*b*, the point of application of the resultant force thereof is generally aligned with the center axis X1 of the bellows 36. More specifically, the air cylinder 41*a* and the air cylinder 41*b* have a point-symmetrical positional relationship in relation to the center axis X1 of the bellows 36. Also, within the surface 36*c* of the second flange 36*b*, the air cylinder 41*a* and the air cylinder 41*b* have a line-symmetrical relationship in relation to a line C-C passing through the center axis X1 of the bellows 36. Moreover, the air cylinder 41*a* and the air cylinder 41*b* are arranged equidistantly from the center axis X1 of the bellows 36, and at equal intervals of 180°.

Additionally, when forces of equal magnitude are applied in the same direction to the two linear guides 42*a* and 42*b*, the point of application of the resultant force thereof is generally aligned with the center axis X1 of the bellows 36. More specifically, the linear guide 42*a* and the linear guide 42*b* have a point-symmetrical positional relationship in relation to the center axis X1 of the bellows 36. Also, within the surface 36*c* of the second flange 36*b*, the linear guide 42*a* and the linear guide 42*b* have a line-symmetrical relationship in relation to a line B-B passing through the center axis X1 of the bellows 36. Moreover, the linear guide 42*a* and the linear guide 42*b* are arranged equidistantly from the center axis X1 of the bellows 36, and at equal intervals of 180°.

The four assist units 43*a*-43*d* are arranged at the four corners of a hypothetical square K centered on the center axis X1. Therefore, when forces of equal magnitude are applied in the same direction to the assist units 43*a*-43*d*, the point of application of the resultant force thereof is generally aligned with the center axis X1 of the bellows 36. More specifically, the assist units 43*a*-43*d* have a point-symmetrical positional relationship in relation to the center axis X1 of the bellows 36. Also, within the surface 36*c* of the second flange 36*b*, the assist units 43*a*-43*d* have a line-symmetrical relationship in relation to the line B-B and the line C-C, respectively, which pass through the center axis X1 of the bellows 36. Further, the linear guide 42*a* and the linear guide 42*b* are arranged equidistantly from the center axis X1 of the bellows 36, and at equal intervals of 90°.

As described above, the plurality of air cylinders 41*a*, 41*b*, the plurality of linear guides 42*a*, 42*b*, and the plurality of assist units 43*a*-43*d* are respectively arranged with uniformity in relation to the center axis X1 of the bellows 36, and therefore when the anode unit 24, driven by the air cylinders 41*a*, 41*b*, undergoes advancing and retracting motion with respect to the casing 25, the anode 17 experiences proper parallel motion with no lateral swaying or tilting. Consequently, the X-ray generation zone 27A and X-ray generation zone 27B in FIG. 4 can face the cathode 16 at the same distance and the same angle with respect to the cathode 16. That is, correct, reproducible positional accuracy of the X-ray generation zones 27A and 27*b* with respect to the cathode 16 can be obtained. As a result, X-rays of different wavelengths can be generated under the same conditions from X-ray generation zones 27A and 27B.

Other Embodiments

While the present invention has been described above in terms of its presently preferred embodiment, the present invention is not limited to this embodiment, and various modifications are possible within the scope of the invention disclosed in the claims.

For example, in the above embodiment, in FIG. 2, the two air cylinders 41*a*, 41*b* and the two linear guides 42*a*, 42*b* are provided equidistantly and at equiangular intervals in relation to the center axis X1 of the bellows 36. Alternatively, three or more air cylinders and linear guides also may be provided equidistantly and at equiangular intervals in relation to the center axis X1 of the bellows 36. As shall be apparent, three or more assist units may also be provided equidistantly and at equiangular intervals in relation to the center axis X1 of the bellows 36.

Figure 6:
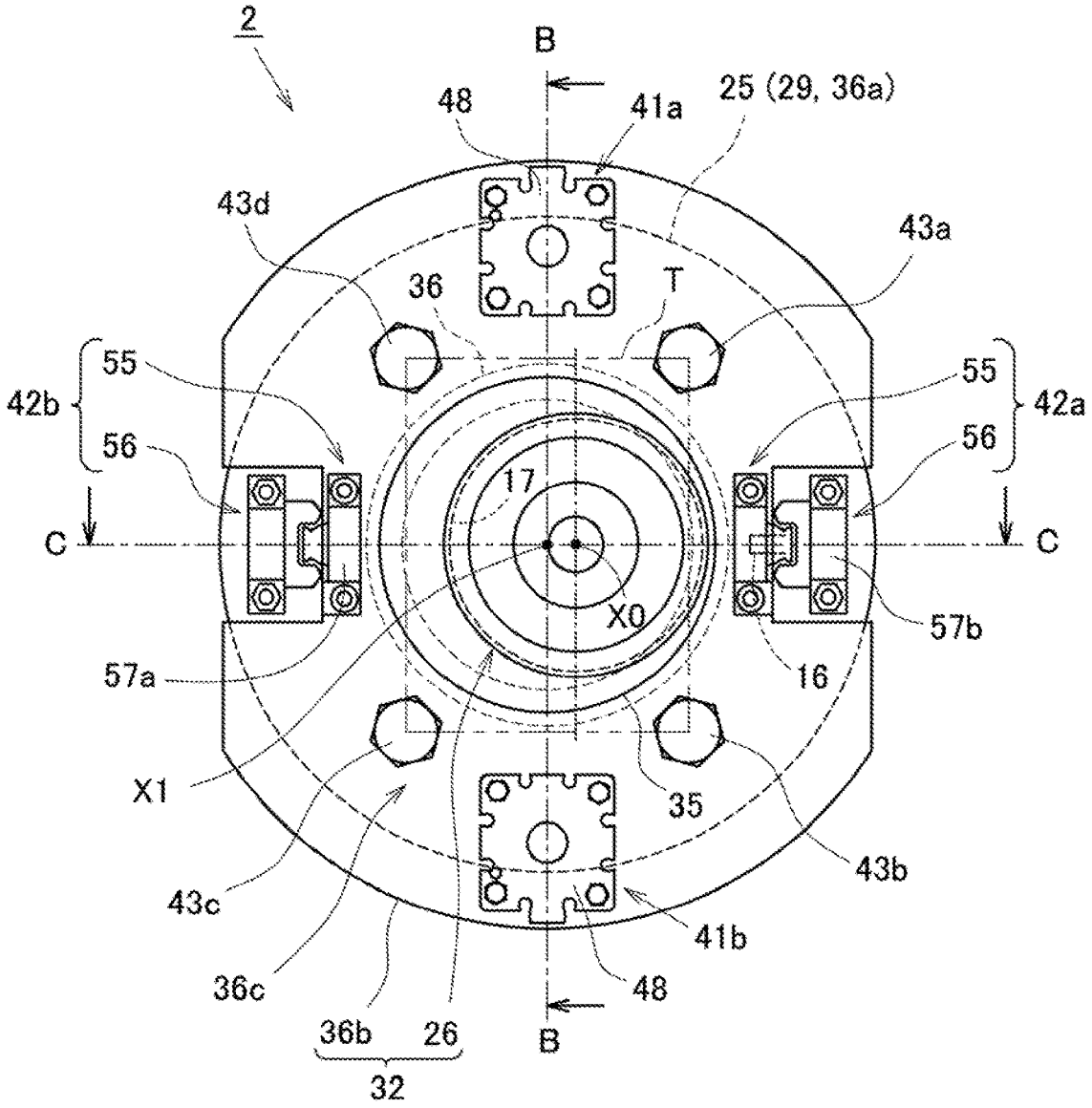
FIG. 6 is a front elevation view showing another embodiment of the X-ray generator according to the present invention.

In the embodiment described above, four assist units 43*a*-43*d* are arranged at the four vertices of an imaginary square K drawn about the center axis X1 of the bellows 36, as shown in FIG. 2. Alternatively, as shown in FIG. 6, the four assist units 43*a*-43*d* may also be arranged at the four vertices of an imaginary rectangle L drawn about the center axis X1 of the bellows 36. Of course, the plurality of air cylinders and the plurality of linear guides, and not only the assist units, may also be arranged at the four vertices of the imaginary rectangle L.

Figure 7:
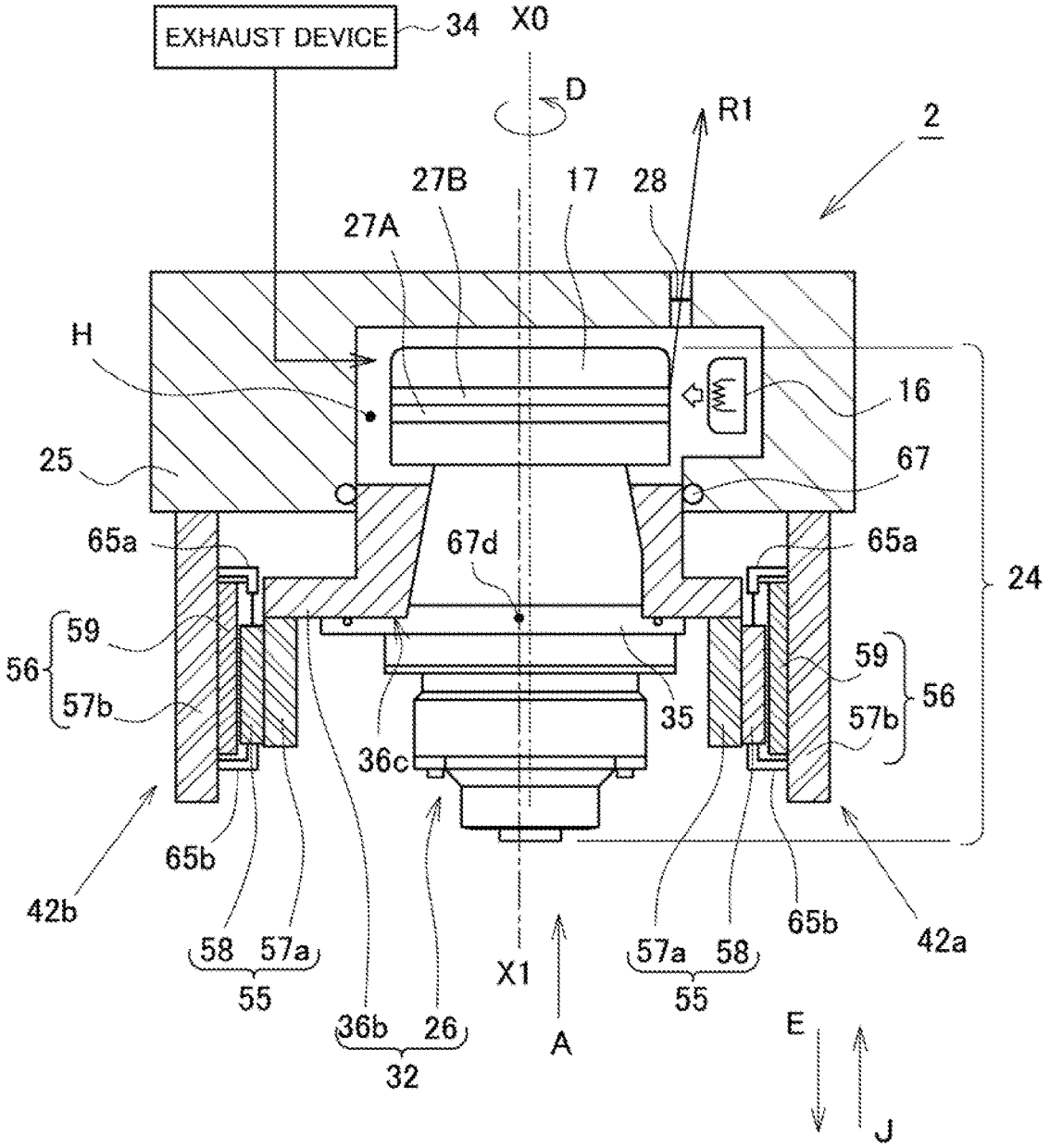
FIG. 7 is a front elevation view showing yet another embodiment of the X-ray generator according to the present invention.

In the embodiment described above, the bellows 36 is employed as the seal member, as shown in FIG. 4. Alternatively, as shown in FIG. 7, an O-ring 67 which is an elastic member may be used as the seal member. In such a case as well, the linear guides 42*a*, 42*b* are disposed uniformly in relation to the center axis X1 of the O-ring 67. Also, the air cylinders 41*a*, 41*b* and the assist units 43*a*-43*d* of FIG. 2, and not only the linear guides 42*a*, 42*b*, are also disposed uniformly in relation to the center axis X1 of the O-ring 67. It should be noted that in FIG. 7 the reference number 67*d* refers to the center point of the O-ring 67. Reference number 36*b* refers to the support plate for supporting the air cylinders, linear guides, and assist units.

In the embodiment described above, the assist units 43*a*, 43*b*, 43*c*, 43*d* are disposed at the four corners of the imaginary square K, as shown in FIG. 2. However, alternatively, as long as the condition that the point of action of the resultant force approximately coincide with the center axis X1 of the bellows 36 acting as the seal member is satisfied, the positions at which the assist units 43*a*, 43*b*, 43*c*, 43*d* are disposed can be any 6 points, 8 points, 10 points, or other number of points on the square K.

Figure 8:
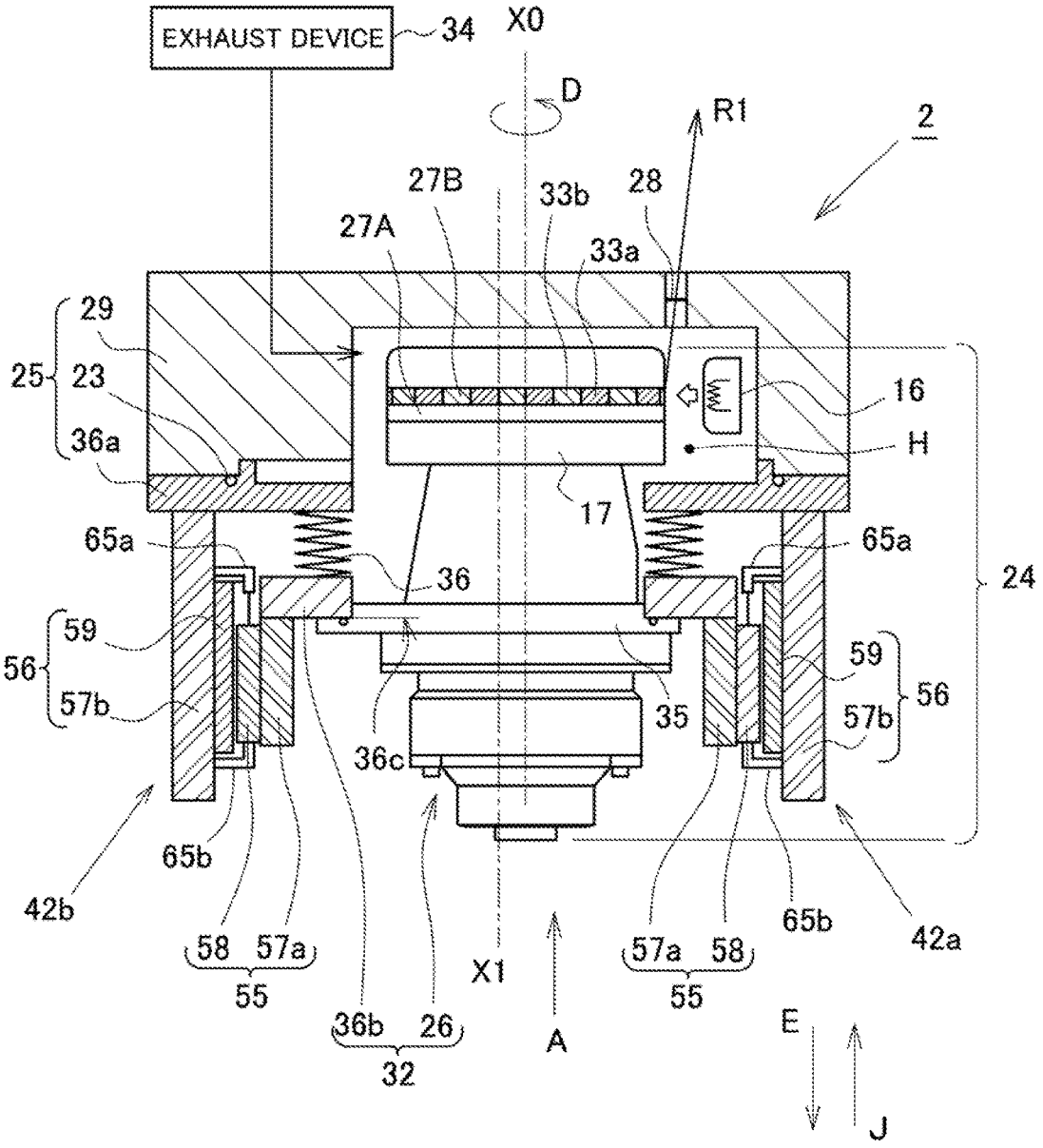
FIG. 8 is a sectional view another embodiment of the X-ray analyzer according to the present invention.

FIG. 8 shows still another embodiment. In this embodiment, one X-ray generation zone 27B is formed by the two types of metal of a first metal 33*a* and a second metal 33*b*. These metals 33*a* and 33*b* are disposed alternatingly along the circumferential direction of the rotating anode 17. The first metal 33*a* is, e.g., copper (Cu) and the second metal 33*b* is, e.g., molybdenum (Mo).

Thus, one X-ray generation zone of a different type of metal is formed in order to generate X-rays of a different wavelength (i.e., different energy) from that X-ray generation zone. This manner of X-ray generation structure is disclosed as a "striped target" in, e.g., Japanese Patent No. 5437180.

It should be noted that in the present embodiment the metal for forming the one X-ray generation zone may be of three or more types.

REFERENCE SIGNS LIST

1. X-ray diffractometer (X-ray analyzer), 2. X-ray generator, 3. goniometer, 4. θ-rotation platform, 5. 2θ-rotation platform, 6. detector arm, 7. divergence slit, 10. specimen holder, 11. scattering slit, 12. receiving slit, 13. two-dimensional X-ray detector (X-ray detection means), 14. two-dimensional sensor, 16. cathode, 17. rotating anode, 23. O-ring, 24. anode unit, 25. casing, 26. anode housing, 27A, 27B. X-ray generation zones, 28. X-ray window, 29. casing base, 30. rotating shaft, 31. water passage, 32. anode support body, 35. anode housing flange, 36. bellows (seal member), 36*a*. first flange, 36*b*. second flange (support plate), 36C. second flange surface, 38. magnetic seal device, 40. motor (rotation driving device), 41*a*, 41*b*. air cylinders (driving means), 42*a*, 42*b*. linear guides (guiding means), 43*a*, 43*b*, 43*c*, 43*d*. assist units (elastic force imparting means), 46. water supply port, 47. water discharge port, 48. cylinder body, 49. output rod, 50. bolt, 51. first air connection port, 52. second air connection port, 55. dovetail tail units, 56. dovetail groove units, 57*a*, 57*b*. support column, 58. dovetail tail, 59. dovetail groove member, 62. through-hole, 63. compression spring, 64. spring cover, 65*a*. first stopper, 65*b*. second stopper, 67. O-ring, H. internal space, Cf. focusing circle, Cg. goniometer circle, F. X-ray focal point, R1. X-rays, R2. diffracted X-rays, X0. axis line of anode housing, X1. center axis line of bellows, θ. X-ray incident angle, 2θ. diffraction angle, ω. center axis

The invention claimed is:

1. An X-ray generator comprising:

a cathode for generating electrons;

an anode provided facing the cathode, and provided with at least two X-ray generation zones lined up adjacent to one another;

a casing that has an interior space for accommodating the cathode and the anode and that is integral with the cathode;

a plurality of driving means for causing the anode to move with respect to the casing;

a plurality of guiding means for guiding the movement of the anode with respect to the casing; and a seal member for keeping the interior space of the casing airtight, the center axis of the seal member extending in a direction parallel to the direction in which the two or more X-ray generation zones are lined up;

wherein the plurality of driving means are provided to different positions in the surface orthogonal to the center axis of the seal member;

the plurality of driving means are provided uniformly in relation to the center axis of the seal member;

the plurality of guiding means are provided to different positions in the surface orthogonal to the center axis of the seal member; and the plurality of guiding means are provided uniformly in relation to the center axis of the seal member.

2. The X-ray generator according to claim 1, wherein the plurality of driving means are equidistant from one another with respect to the center axis of the seal member, and provided at equiangular intervals from one another about the center axis.

3. The X-ray generator according to claim 1, wherein the plurality of driving means are provided in a surface orthogonal to the center axis of the seal member in a manner point symmetrically with respect to the center axis or line symmetrically with respect to a line passing through the center axis.

4. The X-ray generator according to claim 1, wherein the plurality of guiding means are equidistant from one another with respect to the center axis of the seal member, and provided at equiangular intervals from one another about the center axis.

5. The X-ray generator according to claim 1, wherein the plurality of guiding means are provided in a surface orthogonal to the center axis of the seal member point symmetrically with respect to the center axis or line symmetrically with respect to a line passing through the center axis.

6. The X-ray generator according to claim 1, further comprising:

an exhaust means for exhausting the interior space of the casing and reducing pressure in the interior space; and a plurality of elastic-force-imparting means for urging the anode in the direction of exit from the interior space of the casing;

wherein the plurality of elastic-force-imparting means is provided to different positions in a surface orthogonal to the center axis of the seal member; and the plurality of elastic-force-imparting means is provided uniformly in relation to the center axis of the seal member.

7. The X-ray generator according to claim 6, wherein the plurality of elastic-force-imparting means are equidistant from one another with respect to the center axis of the seal member, and provided at equiangular intervals from one another about the center axis.

8. The X-ray generator according to claim 6, wherein the plurality of elastic-force-imparting means are provided in a surface orthogonal to the center axis of the seal member point symmetrically with respect to the center axis or line symmetrically with respect to a line passing through the center axis.

9. The X-ray generator according to claim 1, wherein the seal member is a bellows.

10. The X-ray generator according to claim 1, wherein the driving means comprises an air cylinder for causing an output rod to move back and forth by force of air.

11. An X-ray analyzer, comprising;

the X-ray generator according to claim 1, and an X-ray optical system employing X-rays generated by the X-ray generator.

* * * * *